United States Patent [19]

Kellems et al.

[11] 4,106,158

[45] Aug. 15, 1978

[54] ADJUSTABLE HEIGHT DOOR PIVOT

[75] Inventors: Kenneth K. Kellems, Costa Mesa; Robert Brydolf, Pasadena, both of Calif.

[73] Assignee: Acme General Corporation, San Dimas, Calif.

[21] Appl. No.: 698,299

[22] Filed: Jun. 21, 1976

Related U.S. Application Data

[62] Division of Ser. No. 522,022, Nov. 8, 1974, abandoned.

[51] Int. Cl.[2] ..... E05D 7/04

[52] U.S. Cl. ..... 16/129; 16/131; 49/388; 160/206

[58] Field of Search ..... 49/388; 16/131, 129, 16/151; 160/206

[56] References Cited

U.S. PATENT DOCUMENTS

| | | | |
|---|---|---|---|
| 3,683,453 | 8/1972 | McLeland et al | 160/206 X |
| 3,866,658 | 2/1975 | Smith | 160/206 |

*Primary Examiner*—Kenneth Downey
*Attorney, Agent, or Firm*—Christie, Parker & Hale

[57] ABSTRACT

This pivot assembly for a swinging or folding door can be readily adjusted for door height or position of the door pivot axis relative to the door jamb. An L-shaped bracket is connected into the corner between the floor and door jamb. The bracket has a number of discontinuities parallel to the floor to prevent translation. A pivot is mounted on the lower corner of the door, preferably by a plastic sleeve. The sleeve is threaded on the inside and a threaded pin is mounted therein. The lower end of the pin has means directly engaging the jamb bracket to prevent rotation and translation of the pin. To adjust the door in most embodiments it is lifted so that the head of the pin is out of engagement with the teeth in the slot. The pin is rotated by hand to move it up or down in the threaded sleeve. The pivot axis of the pin is adjusted by moving the pin to a desired position on the bracket. In other embodiments a sliding portion on the pin is moved out of engagement with the bracket to adjust door height and distance of the pivot axis from the jamb.

18 Claims, 17 Drawing Figures

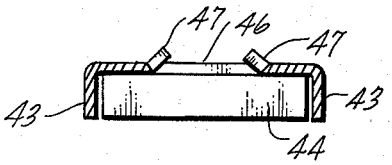
Fig. 5
Fig. 8
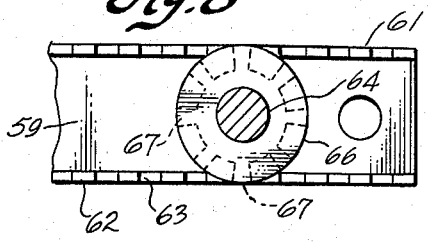
Fig. 9
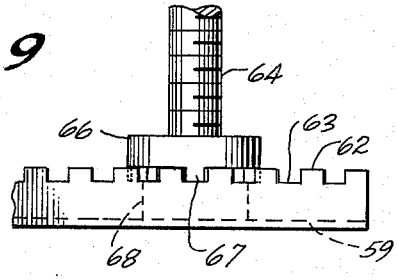
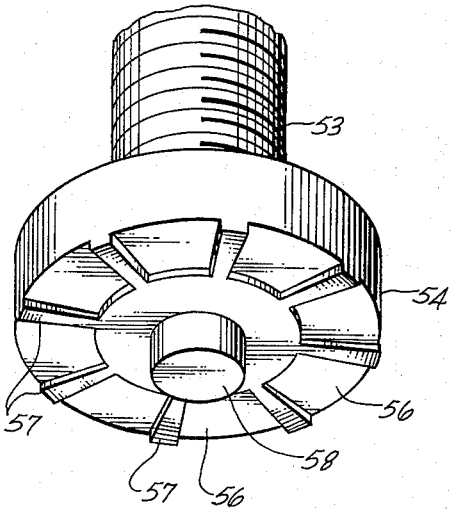
Fig. 7
Fig. 11
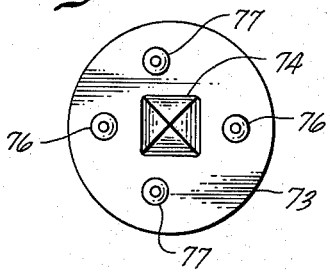
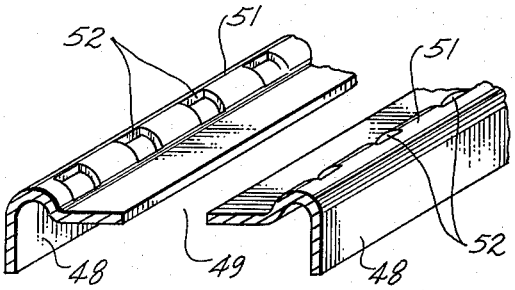
Fig. 6
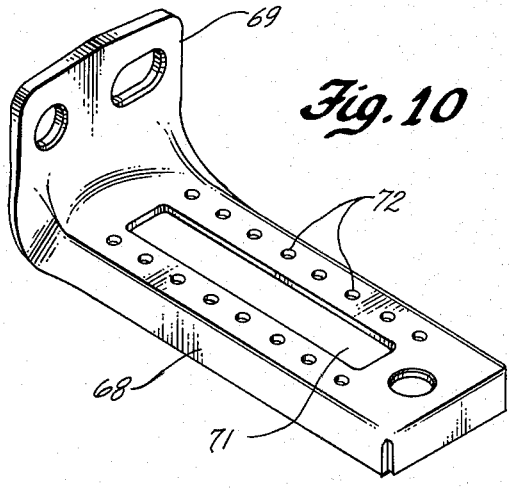
Fig. 10

81
79
80
82
78

94
103
102
101
96
97
98
99
88

89
91
93
92

84
86
87
85
93
83

84
87
85
86
87
86
83
85
104
106
107
113
111
112
108
109

ADJUSTABLE HEIGHT DOOR PIVOT

This is a continuation of application Ser. No. 522,022, filed Nov. 8, 1974 now abandoned.

BACKGROUND

Swinging and folding doors are commonly mounted adjacent the door jamb by way of pivots at the top and bottom. A variety of pivot structures have been made in the past and in general these are not capable of much adjustment. It is desirable, however, to have the ability to adjust the height of the door above the floor to accommodate variations in height of the door frame and also to clear carpeting and the like. It is also desirable to adjust the location of the pivot axis of the door relative to the door jamb so that the upper and lower pivots are aligned and the door is properly positioned in the frame.

U.S. Pat. No. 3,683,453 describes a typical lower pivot for a door which permits both height and pivot axis adjustment. Pivot axis adjustment may be somewhat difficult in such an arrangement. Adjustment of door height is provided by a threaded pin having camming surfaces that, upon rotation of the pin by a wrench, temporarily lift the door and disengage the pin from a nut on the bracket. Such an adjustment calls for use of a wrench for adjusting door height. Special tools may be needed to reposition the pivot axis.

It is desirable to provide an inexpensive lower pivot for a door that is made with a very minimum number of parts, which cannot readily come out of adjustment, and which can be adjusted for both door height and pivot axis position by hand.

BRIEF SUMMARY OF THE INVENTION

There is, therefore, provided in practice of this invention according to a presently preferred embodiment, a lower pivot assembly for a folding or swinging door including a bracket connectable in the corner between the jamb and floor. A plurality of interruptions are provided along the portion of the bracket parallel to the floor. The pivot is connectable to the lower edge of the door and provides for rotational adjustment for door height. An enlarged portion on the lower end of the pin directly engages the jamb bracket to prevent rotation and hence changes in door height. This portion also engages the interruptions to prevent translation along the jamb bracket. A door with such an arrangement can be adjusted by hand simply by lifting the door and rotating the enlarged portion to adjust height or moving the pin along the slot to adjust the position of the pivot axis. Reengagement of the pin with the interruptions prevents rotation or sliding.

DRAWINGS

These and other features and advantages of the present invention will be appreciated as the same becomes better understood by reference to the following detailed description of several presently preferred embodiments when considered in connection with the accompanying drawings wherein:

FIG. 5 is a transverse cross section of a variation of the jamb bracket of FIG. 2;

FIG. 6 illustrates in fragmentary perspective a portion of another embodiment of jamb bracket constructed according to principles of this invention;

FIG. 7 is a perspective view of the bottom of a pivot pin for engaging the jamb bracket of FIG. 6;

FIG. 8 is a horizontal cross section through another embodiment of pivot pin engaging a jamb bracket;

FIG. 9 is a side view of the pin and bracket of FIG. 8;

FIG. 10 illustrates another embodiment of jamb bracket constructed according to principles of this invention;

FIG. 11 is a bottom view of a pivot pin for engaging the jamb bracket of FIG. 10;

DESCRIPTION

Figure 1:
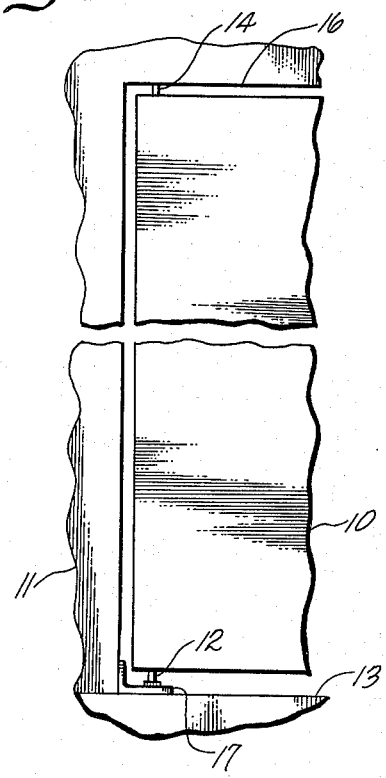
FIG. 1 illustrates schematically a door mounted with a pivot assembly constructed according to principles of this invention.

FIG. 1 illustrates a door 10 hung adjacent a door jamb 11. The door, only a portion of which is shown, is mounted on a lower pivot 12 adjacent the floor 13 and an upper pivot 14 which may be connected to the door frame 16 by any of a number of conventional brackets (not shown). The door can thus swing about the two pivots 12 and 14, which are aligned with each other. The opposite edge (not shown) of the door can be free as when a single door is used. Alternatively this edge may be connected to an adjacent door panel by hinges so that a folding door is obtained. Since this invention concerns the structure at the lower pivot 12 additional details of the upper pivot and door structure which will be apparent to one skilled in the art are not set forth herein.

Figure 2:
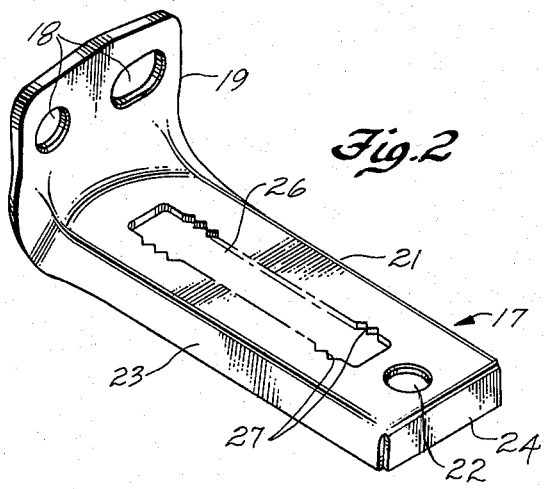
FIG. 2 illustrates in perspective a jamb bracket for the pivot assembly.

A jamb bracket 17 which is illustrated in perspective in FIG. 2 is mounted in the corner between the jamb and floor. The jamb bracket is a generally L-shaped sheet steel stamping. A pair of screw holes 18 are provided on the upstanding leg 19 of the bracket so that it can be fastened to the door jamb. Similarly the leg 21 parallel to the floor has a screw hole 22 for securing the bracket to the floor. The floor leg 21 has its marginal edges 23 bent down, as is the end 24 remote from the jamb, so that the leg stands up above the floor and there is a clearance space beneath it.

The leg 21 parallel to the floor has an elongated slot 26 extending along its length, so that when mounted the slot extends away from the door jamb. Each edge of the slot has a plurality of evenly spaced serrations or teeth 27. These teeth extend in the plane of the floor leg towards each other on opposite sides of the slot. Thus the two sides of the slot are, in effect, a pair of racks pointing towards each other. The teeth are simply a 90° zig-zag or can have more complex shapes if desired.

Figure 4:
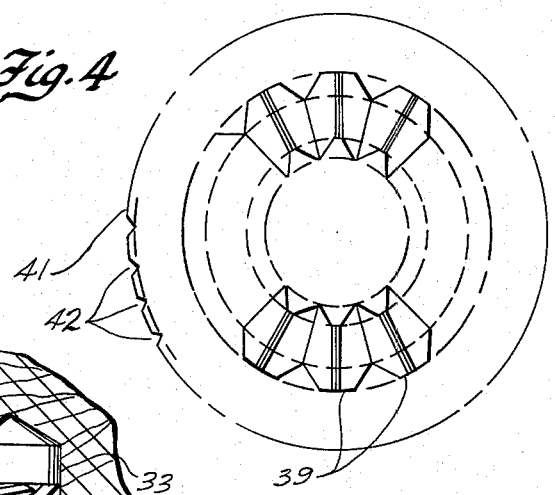
FIG. 4 is an end view of the head of the pivot.
Figure 3:
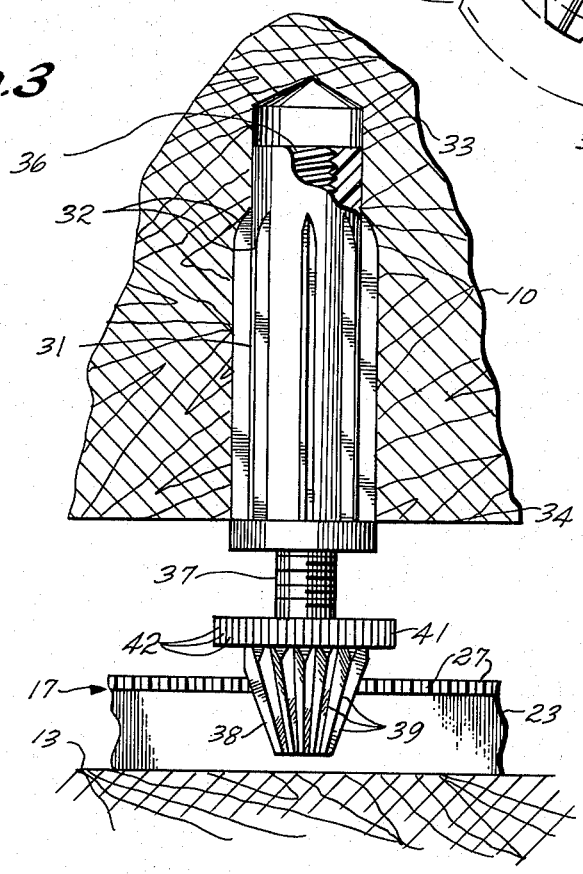
FIG. 3 is a side view of a pivot for the door engaged with the bracket.

FIG. 3 is a side view of the bottom pivot for the door fitted into the bracket and FIG. 4 is a bottom view of that pivot. The pivot has a plastic sleeve 31 with a number of longitudinally extending ridges 32 along most of its length. The sleeve is mounted in the bottom of the door by driving it into a hole 33 having a diameter about the same as that of the cylindrical body of the sleeve. This causes the ribs 32 to engage the wood of the door to prevent rotation of the sleeve. An enlarged flange 34 is provided at the lower end of the sleeve with a diameter about the same as that of the crests of the ribs 32. This flange helps keep the sleeve from being driven too far into the hole in the door.

In the preferred embodiment the pivot is connected to the door by a sleeve that is driven in a hole, which is a desirable structure for a wooden door. In some cases doors are made with thin panels and peripheral metal stiles and rails around the edges. In such an arrangement the sleeve can be connected to the door by any of a variety of conventional corner connectors, and may have an exterior configuration dissimilar from that just described and illustrated.

The interior of the sleeve has a female thread 36 which receives the threaded end of a pivot pin 37. The total length of the threaded portion of the pin may be somewhat longer than the sleeve so that when screwed clear in, its end may protrude into the hole in the door beyond the end of the sleeve. This assures adequate bearing surface on the threads when the pin is extended down from the door.

The lower end of the pin has an enlarged, generally conical head 38 coaxial with the threaded portion. A number of splines 39 extend along the length of the cone, that is, in the same general direction as the length of the pin, so that the head has the general appearance of a bevel gear. The splines are shaped to be complementary to the teeth 27 on the sides of the slot in the jamb bracket. In a typical embodiment the outer edges or crests of the spines are on a cone having a total included angle of about 50° and the roots of the splines are on a cone having an included angle of about 39°. An enlarged flange 41 is provided between the conical head and the threaded shaft 37. A number of small notches 42 are formed around the periphery of this flange to make it easier to turn by hand.

When the sleeve and pivot are installed in a door and the jamb bracket is mounted in the corner, the assembly between the two is made by dropping the conical head 38 into the slot 26 in the jamb bracket. The weight of the door holds the pivot down tightly against the bracket and the splines on the head firmly engage the teeth in the slot. This prevents any rotation of the pin relative to the jamb bracket. The angles of the conical head and teeth are such that there is little, if any, force tending to lift the pin out of engagement with the teeth and rotation can not occur without stripping the teeth or splines. When the door swings there is relative rotation between the pin 37 locked to the bracket 17 and the sleeve 31 embedded in the door. There is a very slight change in elevation of the door as pivoting occurs on the threaded engagement between the pin and pivot, however, this is only a fraction of a turn of the thread and is inconsequential.

If it is desired to adjust the height of the door above the floor one simply lifts the door somewhat so that the splines are out of engagement with the teeth in the jamb bracket. The pin can then be freely rotated with the fingers by, for example simply catching a fingernail in the notches 42 on the flange. The pin can be rotated any desired amount to raise or lower the door and when the head is lowered into reengagement with the teeth in the slot it is firmly locked in that position and the door height cannot inadvertently be changed during usage. A conical shape on the head is desirable so that the pivot is easily fitted into the slot without need for precise alignment. If one raises the door only an amount sufficient to disengage the splines from the teeth, the smaller end of the cone can still be in the slot to keep the door from slipping sideways while height is adjusted.

If one wishes to adjust the position of the pivot axis relative to the door jamb to make it better fit the frame or to bring the axis of the upper and lower pivots into closer alignment, this too can be accomplished without special tools or great difficulty. All one need do is raise the door so that the splines are not in engagement with the teeth and then move the pivot to the desired location along the slot and drop the head back into engagement with the teeth. Since there are teeth along both sides of the slot there is no possibility of movement of the pin along the length of the slot and it is held firmly in position.

Thus, it is seen that no special tools are required for adjusting either door height or pivot axis position of the pivot structure provided in practice of this invention, there is nothing that can come loose or shift in position during usage of the door. This pivot arrangement has a very minimum number of very simple parts and can be installed quickly and reliably for a long useful life.

FIG. 5 illustrates in transverse cross section a slight variation in the jamb bracket usable with the pivot pin arrangement illustrated in FIGS. 3 and 4. In this embodiment the jamb bracket has side edges 43 and an end piece 44 that engage the floor and provide a clearance space between the top of the jamb bracket and the floor. To this extent the jamb bracket is the same as that hereinabove described and illustrated in FIG. 2. A slot 46 extends along the length of the portion of the jamb bracket parallel to the floor and a plurality of teeth 47 are provided along each edge of the slot. In this embodiment the teeth are bent upwardly out of the top plane of the jamb bracket at an angle of about 45% for better engagement with the splines on the enlarged end of the pin.

Considered more broadly, the serrations 27 along the length of the jamb bracket parallel to the floor are a series of interruptions that directly engage the enlarged head on the pin to prevent translation of the pin along the length of the jamb bracket. This direct engagement of the head of the pin and the jamb bracket holds the pivot axis of the door in position. The serrations engaging the splines on the head of the pin also prevent rotation of the pin and hence regulate the height adjustment of the door. In the preferred embodiment illustrated in FIGS. 2 to 4 the cooperative interengagement of the splines on the head and the teeth on the jamb bracket prevent both rotation and translation of the pin. In other embodiments hereinafter described, these two functions are provided by direct engagement between the pivot and a one piece jamb bracket although the structural elements effecting each function may be separated.

FIGS. 6 and 7 illustrate a fragment of another embodiment of jamb bracket and the end of a pivot pin that engage for preventing translation and rotation. The jamb bracket has a pair of side edges 48 that engage the floor and a slot 49 extending along the length of the jamb bracket. When the jamb bracket is stamped, the tops of the side edges 48 are bent to form a ridge 51 extending along the length of the portion of the jamb bracket parallel to the floor. A plurality of holes or windows 52 are provided in the inner sides of these ridges.

The pivot pin illustrated in FIG. 7 has a threaded shank 53 on an enlarged head 54. The bottom face of the head 54 is interrupted by a plurality of radially extending notches 56 that define a plurality of radially extending notches 56 that define a plurality of intervening teeth 57. An axial cylindrical stud 58 projects from this bottom face.

The pin illustrated in FIG. 7 engages the jamb bracket illustrated in FIG. 6 with the stud 58 fitting into the slot 49 along the length of the jamb bracket. The teeth 57 on the bottom face of the enlarged head of the pin fit into respective windows 52 on the ridges along the length of the jamb bracket. This interengagement prevents translation and rotation of the pin in the same general manner as hereinabove described with relation to FIGS. 2 to 4. The stud in the slot provides guidance during adjustment of the pin. It also helps keep the pin centered when the teeth are in engagement with the windows 52. It will be apparent that the teeth 57 may be tapered somewhat for ease of engagement, if desired, rather than the rectangular configuration illustrated in FIG. 7. The interruptions along the length of the jamb bracket can be in the form of deep notches rather than the open holes illustrated in FIG. 6.

FIGS. 8 and 9 illustrate a slight variation in the embodiment illustrated in FIGS. 6 and 7. As illustrated in this arrangement the jamb bracket has a portion parallel to the floor that, in effect, is inverted from that illustrated in FIG. 2. In this embodiment the jamb bracket has a flat portion 59 that rests directly on the floor. The side edges 61 are bent upwardly from this flat portion. The top of each of these side edges is crenellated with a plurality of upwardly extending rectangular teeth 62 and a plurality of intervening notches 63.

The pivot pin has a threaded shank 64 and an enlarged head 66. The bottom face of the head has a plurality of radially extending teeth 67 that engage the respective notches 63 on the two side edges 61 of the jamb bracket. An axially extending stud 68 rests on the bottom flat portion 59 of the jamb bracket and bears the weight of the door. The general configuration of the pivot pin is thus somewhat similar to that of FIG. 7. The interengagement of the teeth 67 on the pivot pin and teeth 62 on the jamb bracket prevents translation and rotation of the pivot pin.

FIG. 10 illustrates in perspective another embodiment of jamb bracket constructed according to principles of this invention. As illustrated in this embodiment the jamb bracket has an elongated leg 68 parallel to the floor and an upstanding leg 69 that fits against the wall. The general configuration of the jamb bracket is similar to that illustrated in FIG. 2. A slot 71 is provided along the length of the jamb bracket and its side edges are smooth. A row of holes 72 is provided through the top portion of the leg 68 parallel to the floor in a pair of rows extending along its length.

FIG. 11 is a bottom view of a pivot pin for engagement with the jamb bracket of FIG. 10. This pin has an enlarged head 73 and a central stud 74 that is square in cross section with a pyramidal lower end. A pair of nibs 76 in the form of truncated cones are provided on opposite sides of the stud 74. A line between the nibs 76 is on the axis of the pivot pin and the distance between the nibs corresponds to the distance between the rows of holes 72 on the jamb bracket. A second pair of similar nibs 77 are provided on the other two sides of the stud 74 spaced apart by the same distance. The line between the second pair of nibs 77 is offset from the axis of the pin by a distance corresponding to one-third the distance between adjacent holes 72 on the jamb bracket.

When the pin of FIG. 11 engages the jamb bracket of FIG. 10 the square stud 74 fits into the slot 71 on the jamb bracket. The square stud prevents rotation of the pivot pin unless it is lifted out of engagement with the slot. The nibs 76 or 77 fit into a pair of holes 72 on the jamb bracket to prevent translation of the pin along its length. By having one pair of nibs 77 offset from the axis of the stud by one-third the distance between adjacent holes one triples the number of possible positions for the pivot axis with a height difference of the door of only one-half the pitch of the thread on the shank of the pin.

Figures 12, 13, 14, 15, 16, 17:
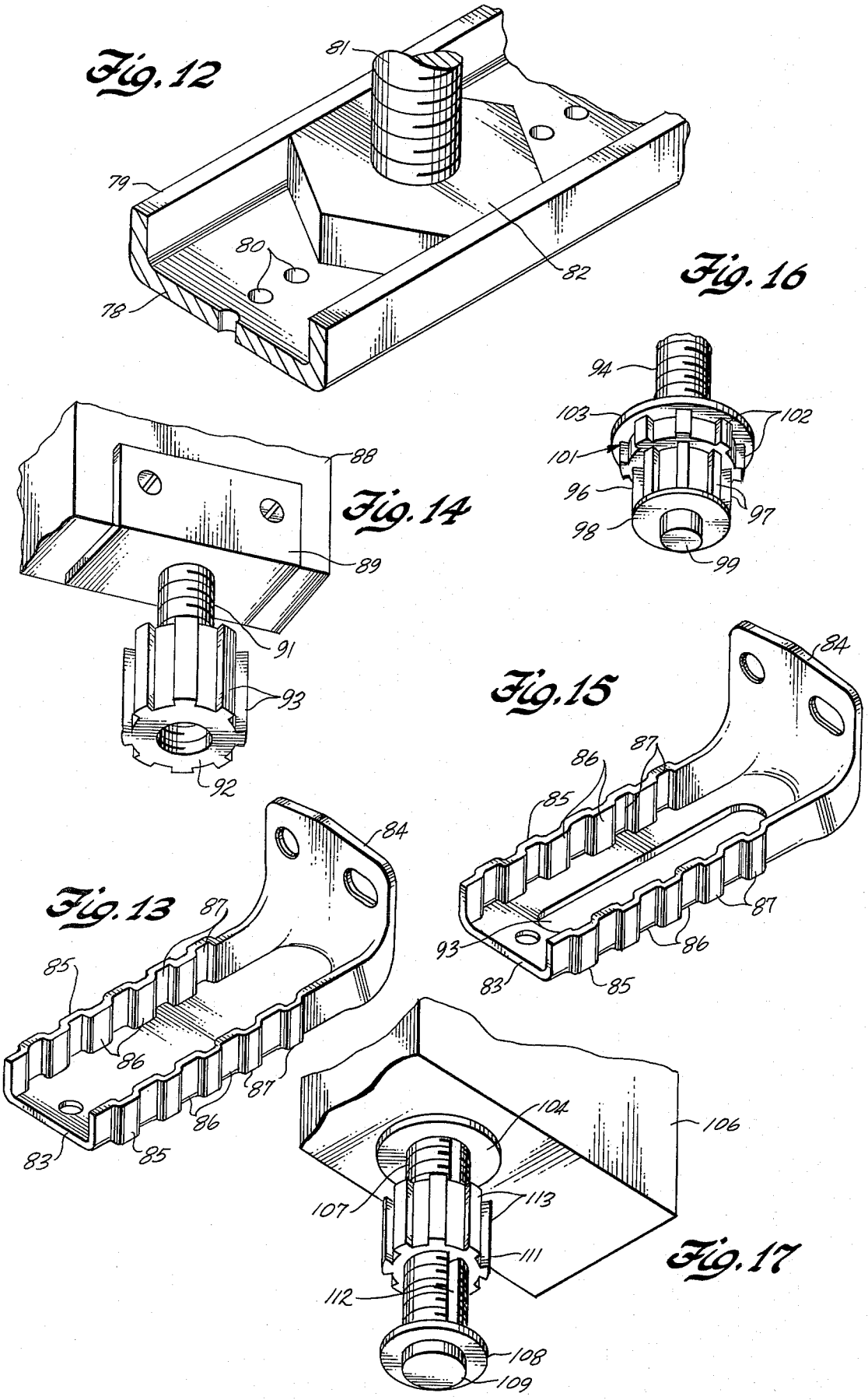
FIG. 12 is a fragmentary perspective indicating engagement of another embodiment of pivot pin with a jamb bracket.
FIG. 13 is a perspective view of another embodiment of jamb bracket constructed according to principles of this invention.
FIG. 14 illustrates a pivot pin on the lower edge of a door for engaging the jamb bracket of FIG. 13.
FIG. 15 illustrates another embodiment of jamb bracket constructed according to principles of this invention.
FIG. 16 illustrates in perspective the lower end of a pivot pin for engaging the jamb bracket of FIG. 15.
FIG. 17 illustrates another embodiment of pivot pin for engaging the jamb bracket of FIG. 15.

FIG. 12 illustrates another quite simple embodiment of engagement between a pivot pin and jamb bracket. In this embodiment the jamb bracket has a flat portion 78 in engagement with the floor and a pair of upturned flanges 79 extending along the side edges. A row of holes 80 is provided along the length of the flat portion 78. The pivot pin has a threaded shank 81 for mounting on a door in the same manner as hereinabove described. The lower end of the pivot pin has an enlarged hexagonal head 82, the flats of which fit between the flanges 79 on the jamb bracket. A short stud (hidden by the head 82) extends axially downwardly from the head and fits into one of the holes 80 in the jamb bracket. The engagement of the sides of the hexagonal head with the flanges prevent rotation of the pivot pin. Engagement of the stud with the holes along the length of the jamb bracket prevent translation.

FIGS. 13 and 14 illustrate in perspective another embodiment of jamb bracket and pivot pin constructed according to principles of this invention. As illustrated in this embodiment the jamb bracket has a generally L-shape, with a flat portion 83 in engagement with the floor. An upstanding leg 84 is used for bolting the jamb bracket to the wall. An upstanding flange 85 is provided along each edge of the flat portion 83 and each of these flanges is corrugated to provide a number of inwardly directed ridges 86 and outwardly extending recesses 87.

In FIG. 14 a pivot arrangement is illustrated connected to the bottom of a door 88 by an L-shaped plate 89. A threaded stud 91 is fixed to the plate and extends downwardly from the door. A nut 92 having a number of longitudinally extending splines 93 is threaded onto the stud 91. The splines 93 fit into the recesses 87 and engage the ridges 86 on the jamb bracket illustrated in FIG. 13 to prevent translation of the pivot assembly along the length of the jamb bracket. This engagement also prevents rotation of the nut 92 on the stud.

To adjust the arrangement illustrated in FIGS. 13 and 14 the door is lifted so that the nut is out of engagement with the jamb bracket and the nut is rotated to give the desired height of the door above the floor. The door is then lowered so that the splines on the nut reingage the ridges on the jamb bracket and prevent translation and rotation. The weight of the door is borne by the lower face of the nut engaging the flat bottom portion of the jamb bracket. Rotation of the door as it pivots occurs by rotation of the stud, which is fixed to the door, relative to the nut, which is fixed to the jamb bracket. It is convenient to make the nut of a tough plastic material and the balance of the pivot assembly out of metal.

FIG. 15 illustrates a modified jamb bracket quite similar to that illustrated in FIG. 13 and the same reference numerals are employed on the drawing to illustrate like parts. This embodiment of the jamb bracket differs from that of FIG. 13 only by provision of a longitudinally extending slot 93 in the flat portion 83 adjacent the floor.

FIG. 16 illustrates a modified pivot arrangement for engagement with the jamb bracket of FIG. 15. In this arrangement a threaded shank 94 is secured to the bottom of a door (not shown). A plastic nut 96 is threaded onto the shank 94 and has a plurality of external splines 97 extending along its length. A rim 98 is provided at the lower end of the nut and a cylindrical axial stud 99 extends downwardly from the flat lower end of the nut.

A "washer" 101 with a plurality of inner splines is mounted with these splines in engagement with the splines 97 on the nut. This permits the washer 101 to slide along the length of the nut without being permitted to rotate relative thereto. The rim 98 prevents the washer from coming off the lower end of the nut. The washer has a plurality of external teeth 102 for engagement in the recesses 87 in the side flanges of the jamb bracket illustrated in FIG. 15. A flange 103 on the washer rests on the top of the side flanges 85 of the jamb bracket.

When the pivot assembly illustrated in FIG. 16 is engaged with the jamb bracket illustrated in FIG. 15, the nut fits between the side flanges of the jamb bracket and the stud 99 fits into the slot 93, thereby keeping the pivot assembly centered and the splines 97 on the nut out of engagement with the ridges on the jamb bracket. The teeth 102 on the washer engage the ridges 86 on the jamb bracket and prevent rotation or translation of the pivot assembly. When it is desired to adjust the height or axial position of the pivot it is not necessary to lift the entire door; only the washer 101 need be lifted out of engagement with the jamb bracket. The washer is then used to rotate the nut for adjusting door height. The pivot can also be slid along the length of the jamb bracket and fixed in a desired position by again lowering the washer into direct engagement with the jamb bracket. If desired the same result can be obtained by making the nut and shank integral and have the threaded shank engage a threaded sleeve (not shown) mounted in or on a door.

FIG. 17 illustrates another embodiment of pivot assembly functioning in a manner generally similar to that of FIG. 16. As illustrated in this embodiment an internally threaded sleeve 104 is mounted in the bottom of a door 106. A threaded pin 107 is fitted into the sleeve and has an enlarged head 108 at its lower end. An axial stud 109 extends downwardly from the enlarged head. When used with a jamb bracket of the type illustrated in FIG. 15 the stud 109 fits into the slot 93 and provides lateral positioning for the pin. The weight of the door is borne by the enlarged head 108.

An enlarged cog 111 is fitted onto the shank 107 for sliding along its length. An internal key on the cog fits into a key way 112 extending along the length of the shank, thereby preventing rotation between the cog and shank. A plurality of external splines 113 are formed on the exterior of the cog 112.

The splines 113 on the cog engage the ridges 86 on a jamb bracket to prevent rotation of the cog and hence rotation of the shank to which it is keyed. This interengagement also prevents translation of the pivot assembly along the length of the jamb bracket. When it is desired to adjust the door height or pivot axis position, the cog is lifted out of engagement with the ridges on the jamb bracket and rotated to adjust door height. Pivot axis position is changed by simply sliding the stud along the slot in the jamb bracket and repositioning the cog in engagement with the side flanges of the jamb bracket in the desired position.

Although several embodiments of door pivot structure incorporating principles of this invention have been described and illustrated herein many other modifications and variations will be apparent to one skilled in the art. Thus for example, the engagement of the straight splines with the jamb bracket can be aided by a slight chamfer on either part. It will also be apparent that the term jamb bracket can include a substantially flat bracket that fastens only to the floor instead of the L shaped bracket that connects both to the floor and door jamb. This gives one the option of fastening the jamb bracket in a position spaced apart from the door jamb. This is done, for example, when a double pair of folding doors is used in a wide opening. A center pair of doors may be mounted on a pair of such brackets or on a single long bracket. Many other modifications and variations will be apparent to one skilled in the art and it is therefore to be understood that within the scope of the appended claims the invention may be practiced otherwise than as specifically described.

What is claimed is:

1. A lower pivot assembly for a swinging door comprising:

a jamb bracket connectable in the corner between a door jamb and the floor;

a slot along a portion of the jamb bracket parallel to the floor;

a plurality of serrations along each side of the slot extending laterally inwardly towards each other;

a sleeve connectable to the bottom of a door and having a female thread;

a threaded pin in the sleeve for adjusting door height by rotating the pin in the sleeve;

an enlarged, generally round, head integral with the lower end of the pin and having a lower portion narrower than the slot and an upper portion wider than the slot, at least the lower portion of said head having a plurality of splines extending in the same general direction as the length of the pin and complementary to the serrations along the edges of the slot so that when the splines on the enlarged head on the lower end of the pin engage the serrations along each edge of the slot both rotation of the pin about its axis and translation of the pin along the jamb bracket are prevented.

2. A pivot assembly as defined in claim 1 wherein the head is in the form of a conical body with longitudinally extending splines.

3. A swinging door pivot assembly comprising:

a jamb bracket connectable to the floor;

a slot extending along the bracket parallel to the floor;

rack means along each edge of the slot parallel to the floor comprising a plurality of teeth along each edge facing towards the teeth on the opposite edge;

a sleeve connectable to the lower edge of a door and having a female thread;

a threaded pin in the sleeve;

an enlarged round head integral with the pin including a portion fittable into the slot between the rack means and a portion wider than the slot for supporting weight of a door; and round gear means on the head having longitudinal splines extending along its length on the portion of the head fittable into the slot and complementary to the rack means for directly engaging the rack means on both sides of the jamb bracket for preventing both rotation and translation of the pin relative to the jamb bracket.

4. A swinging door pivot assembly comprising:

a jamb bracket connectable to the floor;

a slot extending along the bracket parallel to the floor;

rack means along each edge of the slot parallel to the floor comprising a plurality of teeth along each edge facing towards the teeth on the opposite edge;

a sleeve connectable to the lower edge of a door and having a female thread;

a threaded pin in the sleeve;

an enlarged round head on the pin; and gear means on the head in the general form of a bevel gear having a conical body with longitudinally extending splines on a portion of the cone fittable into the slot and complementary to the rack means for directly engaging the rack means on both sides of the jamb bracket for preventing both rotation and translation of the pin relative to the jamb bracket.

5. A swinging door pivot assembly comprising:

a jamb bracket connectable to the floor;

a slot exending along the bracket parallel to the floor;

rack means along each edge of the slot parallel to the floor comprising a plurality of teeth along each edge facing towards the teeth on the opposite edge;

a sleeve connectable to the lower edge of a door and having a female thread;

a threaded pin in the sleeve;

an enlarged round head on the pin; and gear means on the head in the form of a spur gear having a cylindrical body with longitudinally extending splines on the sides of the head fittable into the slot and complementary to the rack means for directly engaging the rack means on both sides of the jamb bracket for preventing both rotation and translation of the pin relative to the jamb bracket.

6. A three piece lower pivot assembly for a swinging door consisting of:

(a) a one piece jamb bracket connectable in the corner between a door jamb and the floor;

(b) a pivot pin including a threaded portion for adjusting the height of a door; and (c) means for connecting the pivot pin to the lower edge of the door; said assembly including:

means for preventing rotation of the pivot pin when engaged with the jamb bracket for fixing the height of a door, and for preventing displacement of the pivot pin along the length of the jamb bracket when engaged therewith for fixing the location of the door pivot axis comprising:

engagement means integral with the pivot pin for directly engaging the jamb bracket; and two rows of discontinuities extending along the length of the jamb bracket parallel to the floor and integral with the jamb bracket, said discontinuities directly engaging the engagement means on the pivot pin for preventing both rotation of the pin relative to the jamb bracket and displacement of the pin along the length of the jamb bracket.

7. A lower pivot assembly for a swinging door consisting of:

a one piece jamb bracket connectable in the corner between a door jamb and the floor;

a pivot pin including a threaded portion for adjusting the height of a door;

means for connecting the pivot pin to the lower edge of the door;

engagement means comprising an enlarged round head integral with the lower end of the pivot pin, said head having a plurality of splines on its sides extending along the sides in the same general direction as the length of the pin; and means for preventing rotation of the pivot pin for fixing the height of a door and for preventing displacement of the pivot pin along the length of the jamb bracket when engaged therewith for fixing the location of the door pivot axis comprising:

a plurality of the discontinuities along the length of the jamb bracket parallel to the floor and integral with the jamb bracket, said discontinuities directly engaging the splines on the head of the pivot pin for preventing both rotation of the pin relative to the jamb bracket and displacement of the pin along the length of the jamb bracket.

8. A lower pivot assembly for a swinging door comprising:

a one piece jamb bracket connectable in the corner between a door jamb and the floor;

a slot along a portion of the jamb bracket parallel to the floor;

a plurality of serrations along each side of the slot extending laterally inwardly towards each other;

a sleeve connectable to the bottom of a door and having a female thread;

a threaded pin in the sleeve;

an enlarged conical head on the lower end of the pin, the head being smaller at its lower end than the width of the slot and larger at its upper end than the width of the slot for supporting a door; and a plurality of splines extending along the length of the cone and complementary to the serrations along the sides of the slot for preventing rotation of the pin about its axis and translation of the pin along the jamb bracket.

9. A door pivot assembly as defined in claim 8 further comprising an enlarged serrated flange between the conical head and the threaded portion of the pin, and wherein the conical head is coaxial with the pin, the enlarged serrated flange providing a means for finger rotation of the pin to adjust the position of the conical head with respect to the sleeve and thereby adjust the height of the door.

10. A lower pivot assembly for a swinging door comprising:

a one piece jamb bracket connectable in the corner between a door jamb and the floor;

a pivot pin including a threaded portion for adjusting the height of a door;

means for connecting the pivot pin to the lower edge of the door;

engagement means comprising an enlarged generally conical head on the lower end of the pivot pin, said head having a plurality of splines extending in the same general direction as the length of the pin, the conical portion being larger at the upper end and smaller at the lower end with the splines extending along the length of the conical portion; and a plurality of discontinuities along the length of the jamb bracket parallel to the floor and integral with the jamb bracket, said discontinuities directly engaging the splines on the head of the pivot pin for preventing both rotation of the pivot pin and displacement of the pivot pin along the length of the jamb bracket for fixing the height of a door and for fixing the location of the door pivot axis.

11. A lower pivot assembly as defined in claim 10 wherein the jamb bracket comprises a slot along its length and the discontinuities comprise a plurality of serrations along each side of the slot extending laterally inwardly towards the serrations on the opposite side of the slot, the width of the slot being greater than the width of the lower end and less than the width of the upper end of the conical portion.

12. A lower pivot assembly for a swinging door comprising:

a jamb bracket connectable in the corner between a door jamb and the floor;

a slot along a portion of the jamb bracket parallel to the floor;

a plurality of serrations along each side of the slot extending laterally inwardly towards each other;

a sleeve connectable to the bottom of a door and having a female thread;

a threaded pin in the sleeve for adjusting door height by rotating the pin in the sleeve;

an enlarged head on the lower end of the pin, said head having a generally conical shape smaller at its lower end and larger at its upper end and a plurality of splines extending along the length of the cone in the same general direction as the length of the pin, the splines being complementary to the serrations along the sides of the slot so that when the splines on the enlarged head on the lower end of the pin engage the serrations along each side of the slot both rotation of the pin about its axis and translation of the pin along the jamb bracket are prevented.

13. A door pivot assembly as defined in claim 12 further comprising an enlarged serrated flange between the head and the threaded portion of the pin, the enlarged serrated flange providing a means for finger rotation of the pin to adjust the position of the conical head with respect to the sleeve and thereby adjust the height of the door.

14. A door pivot assembly as defined in claim 13 wherein the jamb bracket includes means along the portion parallel to the floor for spacing the serrations apart from the floor to provide a space beneath the bracket to accommodate the smaller end of the head.

15. A door pivot assembly as defined in claim 12 wherein the serrations are tilted upwardly from the top of the jamb bracket approximately complementary to the splines on the cone.

16. A lower pivot assembly for a swinging door comprising:

a one piece jamb bracket connectable in the corner between a door jamb and the floor;

a pivot pin including a threaded portion;

a threaded sleeve for connecting the pivot pin to the lower edge of the door;

a generally round and conical enlarged head on the lower end of the pivot pin for directly engaging the jamb bracket, said head having a plurality of splines around the head extending in the same general direction as the length of the pin, the conical portion being larger at the upper end and smaller at the lower end with the splines extending along the length of the conical portion; and means for preventing rotation of the head on the pivot pin and preventing displacement of the pivot pin along the length of the jamb bracket when engaged therewith comprising a slot in the jamb bracket having a plurality of discontinuities along the length of the jamb bracket parallel to the floor, said discontinuities comprising a plurality of serrations along each side of the slot extending laterally inwardly towards the serrations on the opposite side of the slot, the width of the slot being greater than the width of the lower end and less than the width of the upper end of the conical head, and said discontinuities directly engaging the splines on the head of the pivot pin for preventing both rotation and displacement of the pin.

17. A three piece lower pivot assembly for a swinging door consisting of:

(a) a bracket conectable to the floor beneath a door, a slot extending along the bracket parallel to the floor, and a rack extending along each side edge of the slot; having teeth extending laterally inwardly towards each other;

(b) a sleeve connectable to the lower edge of a door and having a female thread; and (c) a threaded pin in the sleeve, a round head integral with the pin at its lower end including a portion wider than the slot, and a gear integral with the head having a portion fittable into the slot with generally longitudinally extending splines complementary to the racks for directly engaging both racks along the slot for preventing both translation of the pin along the slot and rotation of the pin relative to the bracket.

18. A three piece lower pivot assembly for a swinging door consisting of:

(a) a bracket connectable to the floor beneath a door, a slot extending along the bracket parallel to the floor, and a rack extending along each side edge of the slot;

(b) a sleeve connectable to the lower edge of a door and having a female thread; and (c) a threaded pin in the sleeve, a head integral with the pin at its lower end including a portion wider than the slot, and a bevel gear integral with the head having a conical body with generally longitudinally extending splines complementary to the racks for directly engaging both racks along the slot for preventing both translation of the pin along the slot and rotation of the pin relative to the bracket.

* * * * *

UNITED STATES PATENT AND TRADEMARK OFFICE

CERTIFICATE OF CORRECTION

PATENT NO. : 4,106,158

DATED : August 15, 1978

INVENTOR(S) : Kenneth K. Kellems, Robert Brydolf

It is certified that error appears in the above-identified patent and that said Letters Patent are hereby corrected as shown below:

Column 3, line 41, "spines" should be -- splines --.

Column 5, line 9, "on" should be -- and --;

Column 5, lines 11, 12, "radially extending notches 56 that define a plurality of" should be deleted.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*